US007455297B2

(12) United States Patent
Tang

(10) Patent No.: US 7,455,297 B2
(45) Date of Patent: Nov. 25, 2008

(54) ASIA POKER WITH THREE HANDS PER PLAYER

(76) Inventor: Matthew Tang, 1525 Ocean Ave., Pleasantville, NJ (US) 08232

( * ) Notice: Subject to any disclaimer, the term of this patent is extended or adjusted under 35 U.S.C. 154(b) by 384 days.

(21) Appl. No.: 11/202,239

(22) Filed: Aug. 12, 2005

(65) Prior Publication Data

US 2007/0035091 A1 Feb. 15, 2007

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | |
|---|---|---|---|---|
| 4,861,041 | A | 8/1989 | Jones et al. | |
| 5,098,107 | A | 3/1992 | Boylan et al. | |
| 5,294,128 | A * | 3/1994 | Marquez | 273/292 |
| 5,584,486 | A | 12/1996 | Franklin | |
| 5,863,041 | A * | 1/1999 | Boylan et al. | 273/292 |
| 6,155,568 | A * | 12/2000 | Franklin | 273/292 |
| 6,474,646 | B1 * | 11/2002 | Webb | 273/274 |
| 6,793,220 | B1 * | 9/2004 | Feola | 273/292 |
| 2003/0030217 | A1 * | 2/2003 | Webb | 273/274 |
| 2006/0192339 | A1 * | 8/2006 | Byrne et al. | 273/292 |
| 2007/0126181 | A1 * | 6/2007 | Ciaffone | 273/292 |

OTHER PUBLICATIONS

Wikipedia, "Chinese Poker," http://en.wikipedia.org/wiki/Chinese_poker, May 11, 2007.

* cited by examiner

*Primary Examiner*—Gene Kim
(74) *Attorney, Agent, or Firm*—Stite & Harbison PLLC; Ross F. Hunt, Jr.

(57) ABSTRACT

The standard game of Asia Poker is modified by dividing the seven cards dealt to each participant into three groups or hands rather than two, with the three groups containing four cards, two cards or one card, respectively. To win, a player must win on at least two of three hands, and because there are three hands rather than two, the number of tied hands or "pushes" is greatly reduced. Further, by providing that the dealer (whether the house(casino) or a customer acting as the banker) wins all ties or "copy hands," such "pushes" can be completely eliminated.

17 Claims, No Drawings

ASIA POKER WITH THREE HANDS PER PLAYER

FIELD OF THE INVENTION

The present invention relates to the general field of games of chance and, more particularly, to improvements in the game of Asia Poker.

BACKGROUND OF THE INVENTION

The game of Asia Poker, often referred to as Pai Gow Poker, is gaining increased acceptance by casinos and other major gambling centers. In this game, a player is dealt seven cards which are arranged by the player to make two hands, viz., a two-card hand (low hand) and a five-card hand (high hand). The only requirement in forming the hands is that the low hand must be of a lower rank than the high hand. The ranking of the hands are the same as in traditional poker with the exception that the joker can be used to represent an ace or to represent one card of either a straight or a flush. Because of the use of a joker, five aces is the highest possible hand.

The game is started by each player placing a bet (ante). The dealer then deals seven cards to himself and each of six players. Usually, the dealer is a casino employee and the players compete against the casino by attempting to beat the dealer, although the dealer can be a customer as discussed below.

In playing the game, when the player forms his low hand and his high hand so that they are both respectively higher in rank than the low hand and the high hand of the dealer, the player is declared to be the winner and the dealer is a loser. Conversely, when the player forms his low hand and his high hand so that they are respectively lower in rank than the low hand and high hand of the dealer, the player is the loser and the dealer is the winner. The dealer wins all tied hands. Further, if the player wins one hand and the dealer wins the other hand, a "push" is declared and no one wins. If a player wins both hands, the bet made is matched, i.e., an even money bet is paid, less a commission of typically 5%.

As will be evident from the foregoing, no money exchanges hands, i.e., the bet is neither won or lost, when there is a push. It has been estimated that approximately forty percent of the outcomes in Asia Poker are pushes. The occurrence of a push or tie obviously diminishes the excitement of a hand, and because there are so many pushes, Asia Poker has limited appeal for many. Moreover, casinos and other gambling establishments prefer a game wherein there are more winning hands given that, in the long run, the casino will come out ahead because tie hands go to the casino, and the casino receives a commission in any event.

SUMMARY OF THE INVENTION

Generally speaking, in accordance with an important aspect of the invention, the standard game of Asia Poker is modified by dividing the seven cards dealt to each participant into three groups rather than two, with the three groups containing four cards, two cards and one card, respectively. To win a player must win on at least two of three hands, and because there are three hands rather than two, the number of "pushes" is greatly reduced. Further, because in a preferred embodiment, the dealer (whether the house (casino) or a customer acting as the banker) wins all ties or "copy hands," "pushes" can be completely eliminated.

In accordance with another aspect of the invention, there is provided a method of playing a game of chance involving six players and a dealer, wherein each player plays against the dealer, and using a deck of cards including at least the 52 cards of a standard deck, said method comprising:

placing a wager by each of the six players;

dealing, by the dealer, a total of seven cards to the dealer and a total of seven cards to each of the six players;

arranging of the cards, by the dealer and each player, into a low hand of one card, a medium hand of two cards and a high hand of four cards wherein the medium hand must be higher in rank than the low hand and the high hand must be higher in rank than the medium hand, individually comparing each of the low, medium and high ranks of each player with the low, medium and high hands of the dealer;

determining a winner between each player and the dealer when at least two out of the three hands of one is of higher rank than the corresponding hands of the other, and taking the wager of the player by the dealer when the dealer is determined to be the winner, and paying, by the dealer, the amount of the wager by a player to a player determined to be the winner.

Preferably, when the dealer and a player have a corresponding hand of equal rank, and the dealer is determined to be the winner.

In one embodiment, the deck of cards includes at least one joker that, in playing of the game, can be used as aces, straight and flush only.

In another embodiment, a standard 52 card deck is used.

Preferably, the rankings of the four cards, from highest to lowest poker hand, is as follows:

(i) four aces;

(ii) a royal flush formed by A, K, Q, J of the same suit;

(iii) a straight flush formed by four cards in consecutive rank of the same suit, wherein the highest ranking straight flush is A, 2, 3, 4 of the same suit and the second highest is K, Q, J, 10 of the same suit;

(iv) a flush formed by four cards of the same suit, regardless of rank, wherein the highest ranking card determines the highest flush;

(v) a straight formed by four cards consecutive in rank, regardless of suit, wherein the highest ranking card will determine the highest straight, wherein A, K, Q, J is the highest ranking straight, A, 2, 3, 4 is the second highest straight and 5, 4, 3, 2 is the lowest straight;

(vi) three of a kind formed by three cards of the same rank regardless of suit wherein three aces is the highest ranking three of a kind and three twos is the lowest ranking three of a kind;

(vii) two pair formed by two different pairs of the same rank in the same hand, wherein two aces and two kings is the highest ranking two pair, and two threes and two twos is the lowest ranking two pair;

(viii) one pair wherein two aces is the highest ranking pair and two twos is the lowest ranking pair; and (viiii) no pair, which occurs when none of the poker hands set forth above are formed and wherein the highest ranking single card will determine the winner wherein, and in comparing hands of a player of the of that dealer, the highest ranking card is identical, the next highest ranking card will determine the winner.

Preferably, for medium, two card hands, the highest hand is a pair of aces and the lowest hand is 2, 3.

Preferably, for low, one card hands, the highest hand is an ace and the lowest hand is a two.

In one embodiment, the dealer is a casino employee.

In another embodiment, the dealer is a casino customer.

In yet another aspect of the invention, there is provided a method of playing a game of chance involving six players and a dealer wherein each player plays against the dealer, and using a deck of cards comprised of a standard deck of 52 cards, said method comprising:

dealing, by the dealer, a total of seven cards to the dealer and a total of seven cards to each of the six players;

arranging of the cards, by the dealer and each player, into a low hand of one card, a medium hand of two cards and a high hand of four cards, wherein the medium hand must be higher in rank than the low hand and the high hand must be higher in rank than the medium hand, individually comparing each of the low, medium and high hands of each player with the low, medium and high hands of the dealer;

determining a winner between each player and the dealer when at least two out of the three hands of one is of higher rank than the corresponding hands of the other, wherein when the dealer and a player have a corresponding hand of equal rank, and the dealer is determined to be the winner.

Preferably, as above, the rankings of the high hands of four cards, from highest to lowest poker hand, is as follows:

(i) four aces;

(ii) a royal flush formed by A, K, Q, J of the same suit;

(iii) a straight flush formed by four cards in consecutive rank of the same suit, wherein the highest ranking straight flush is A, 2, 3, 4 of the same suit and the second highest is K, Q, J, 10 of the same suit;

(iv) a flush formed by four cards of the same suit, regardless of rank, wherein the highest ranking card determines the highest flush;

(v) a straight formed by four cards consecutive in rank, regardless of suit, wherein the highest ranking card will determine the highest straight, wherein A, K, Q, J is the highest ranking straight, A, 2, 3, 4 is the second highest straight and 5, 4, 3, 2 is the lowest straight;

(vi) three of a kind formed by three cards of the same rank regardless of suit wherein three aces is the highest ranking three of a kind and three twos is the lowest ranking three of a kind;

(vii) two pair formed by two different pairs of the same rank in the same hand, wherein two aces and two kings is the highest ranking two pair, and two threes and two twos is the lowest ranking two pair;

(viii) one pair wherein two aces is the highest ranking pair and two twos is the lowest ranking pair; and (viiii) no pair, which occurs when none of the poker hands set forth above are formed and wherein the highest ranking single card will determine the winner, and wherein, in comparing hands of a player of that of the dealer, the highest ranking card is identical, the next highest ranking card will determine the winner.

Also as above, for medium hands, the highest hand is a pair of aces and the lowest hand is 2, 3, while for low hands, the highest hand is an ace and the lowest hand is a two.

Further features and advantages of the present invention will be set forth in, or apparent from, the detailed description of preferred embodiments thereof which follows.

DESCRIPTION OF THE PREFERRED EMBODIMENTS

As discussed above, the game of the present invention is similar to the basic game of Asia Poker but in accordance with an important feature thereof, instead of dividing the seven cards dealt to each of the seven players (in a casino setting, a dealer deals to six players) into two groups of five and two, the cards are divided into three groups of four, two and one. The groups are designated as low, medium and high hands and, in accordance with a preferred embodiment, when the cards dealt to a player are divided into the three groups, the medium (two-card) hand must be higher than the low (one-card) hand and high hand must be higher than the medium hand.

As indicated above, in order to beat the dealer, a player must win on two out of three hands. Because there are three possibilities of winning and winning two out of three beats the dealer, there are substantially no "pushes," i.e., there are no overall hands wherein the player ties with the dealer. This substantially eliminates this unattractive feature of standard Asia Poker wherein, as discussed above, there are only two groups and thus may ties between a dealer and player.

In a preferred embodiment, in accordance with the standard rules of Asia Poker, all ties ("copy hands") go to the dealer, i.e., the dealer wins all hands of the three hands wherein the hands of the dealer and player are of an equivalent value. In this embodiment, all overall pushes are eliminated.

In a preferred embodiment, a joker is not used as in conventional Asia Poker so that a standard fifty-two card can be used, although, of course, in other embodiments, one, or even more than one, joker can be used, as desired.

The highest winning hand for the low hand (one card) is an ace while a deuce is the lowest and the person having the highest card wins.

The highest winning hand for the medium hand is a pair of aces. A pair beats a non-pair and if there are no pairs, the highest card wins.

With respect to the high hand (four card) rankings, the following rankings are preferably used:

1. Four Aces;

2. Royal Flush: A, K, Q, J of the same suit;

3. Straight flush: four cards in consecutive rank of the same suit. The highest ranking straight flush is A, 2, 3, 4 of the same suit. The second highest is K, Q, J, 10 of the same suit;

4. Flush: four cards of the same suit, regardless of rank. The highest ranking card will determine the highest flush.;

5. Straight: four cards in a consecutive run, regardless of suit. The highest ranking card will determine the highest straight. A, K, Q, J is the highest ranking straight. A, 2, 3, 4 is the second highest straight. 5, 4, 3, 2 is the lowest straight;

6. Three of a kind: three cards of the same rank, regardless of suit. Three aces is the highest ranking three of a kind. Three twos is the lowest ranking three of a kind.

7. Two pairs: two pairs contained in the same hand. Two aces and two kings is the highest ranking hand. Two threes and two twos is the lowest ranking hand.

8. One pair: two aces is the highest ranking pair. Two twos is the lowest ranking pair.

9. No pair: when none of the poker hands listed above are formed by any of the four card hands, the highest ranking single card will determine the winner. Further, if no player even has a pair, and when comparing the hands of a player and the dealer, the highest ranking card is identical of a player and the dealer, the next highest ranking card will determine the winner. In one preferred embodiment, if every card in the hands being compared is identical, this is all "copy" hand and the bank or dealer wins all copy hands.

As will be apparent from the foregoing, the object of the game is to beat at least two hands out of three hands (either high, medium or low) held by the banker or dealer. It will be understood that the banker or dealer can be, for example, a casino dealer or a customer at the table, as discussed below. As indicated above, in a preferred embodiment, the game is played with a traditional deck of 52 playing cards. Each customer receives seven cards and will form three hands.

Conveniently, in playing the game, the three hands are arranged in a column in front of the player, with the single card hand at the front and the four card hand at the back. As stated, one hand, the high hand or back hand, will have four cards, a second, the medium or middle hand, will have two cards, and the low hand or front hand will have one card. Preferably, the house handles all bets and charges a 5% commission on all winning wagers.

Hands are ranked as traditional poker hands with the possible exceptions discussed above and a customer wins when two customer hands are higher than those of the banker. The customer loses when two customer hands out of there are lower than those of the banker.

As indicated above, for medium (two-card) hands, the highest hand is a pair of aces and the lowest hand is 2, 3 while for low (one-card) hands, the highest hand is an ace and the lowest hand is a two.

One of the interesting aspects of conventional Asia Poker is the opportunity for a customer to bank the game. The dealer, i.e., the dealer for the house, may offer the bank to a customer only after the dealer has acted as the banker to begin the round of play. Each customer at the table shall have the option to either be the bank or pass the bank to the next customer. The dealer shall, starting with the customer farthest to the right of the dealer, offer the bank to each customer in a counterclockwise rotation around the table until a customer accepts the bank. The dealer shall place a token or the like in front of the customer who accepts the bank. The banking option shall rotate in a counterclockwise direction around the table until it returns to the dealer. In conventional Asia Poker, a customer may never bank two consecutive rounds of play and may only wager one position when banking the game.

Before a customer may be permitted to bank a round of play, the dealer shall first determine that: the customer placed a wager against the dealer, when the dealer was the bank; and the customer has sufficient gaming chips on the table to cover all of the wagers placed by the other customers at the table for that round of play. If the customer does not have chips enough, cash shall be changed at that time and the chips placed in front of the banking customer, but not on the betting area.

Although the invention has been described above in relation to preferred embodiments thereof, it will be understood by those skilled in the art that variations and modifications can be effected in these preferred embodiments without departing from the scope and spirit of the invention.

What is claimed:

1. A method of playing a game of chance involving up to six players and a dealer, wherein each player plays against the dealer, and using a deck of cards including at least the 52 cards of a standard deck, said method comprising:

placing a wager by each of the six players;

dealing, by the dealer, a total of seven cards to the dealer and a total of seven cards to each of the six players;

arranging of the cards, by the dealer and each player, into a low hand of one card, a medium hand of two cards and a high hand of four cards so that, during play, poker hands of four of a kind and two pair can be formed in forming the four card high hand depending on the cards that are dealt, wherein the medium hand must be higher in rank than the low hand and the high hand must be higher in rank than the medium hand, individually comparing each of the low, medium and high ranks of each player with the low, medium and high hands of the dealer;

determining a winner between each player and the dealer when at least two out of the three hands of one is of higher rank than the corresponding hands of the other, and taking the wager of the player by the dealer when the dealer is determined to be the winner, and paying, by the dealer, the amount of the wager by a player to a player determined to be the winner.

2. The method of claim 1, wherein when the dealer and a player have a corresponding hand of equal rank, the dealer is determined to be the winner.

3. The method of claim 1, wherein the deck of cards includes at least one joker that, in playing of the game, can be used as an ace in a straight or flush only.

4. The method of claim 1, wherein a standard 52 card deck is used.

5. The method of claim 4, wherein the rankings of the four cards, from highest to lowest poker hand, is as follows:

(i) four aces;

(i) a royal flush formed by A, K, Q, J of the same suit;

(iii) a straight flush formed by four cards in consecutive rank of the same suit, wherein the highest ranking straight flush is A, 2, 3, 4 of the same suit and the second highest is K, Q, J, 10 of the same suit;

(iv) a flush formed by four cards of the same suit, regardless of rank, wherein the highest ranking card determines the highest flush;

(v) a straight formed by four cards consecutive in rank, regardless of suit, wherein the highest ranking card will determine the highest straight, wherein A, K, Q, J is the highest ranking straight, A, 2, 3, 4 is the second highest straight and 5, 4, 3, 2 is the lowest straight;

(vi) three of a kind formed by three cards of the same rank regardless of suit wherein three aces is the highest ranking three of a kind and three twos is the lowest ranking three of a kind;

(vii) two pair formed by two different pairs of the same rank in the same hand, wherein two aces and two kings is the highest ranking two pair, and two threes and two twos is the lowest ranking two pair;

(viii) one pair wherein two aces is the highest ranking pair and two twos is the lowest ranking pair; and (viiii) no pair, which occurs when none of the poker hands set forth above are formed and wherein the highest ranking single card will determine the winner wherein, and in comparing hands of a player of the of that dealer, the highest ranking card is identical, the next highest ranking card will determine the winner.

6. The method of claim 4, wherein the dealer is a casino customer.

7. The method of claim 1, wherein for medium, two card hands, the highest hand is a pair of aces and the lowest hand is 2, 3.

8. The method of claim 1, wherein for low, one card hands, the highest hand is an ace and the lowest hand is a two.

9. The method of claim 1, wherein the dealer is a casino employee.

10. A method of playing a game of chance involving up to six players and a dealer wherein each player plays against the dealer, and using a deck of cards comprised of a standard deck of 52 cards, said method comprising:

dealing, by the dealer, a total of seven cards to the dealer and a total of seven cards to each of the six players;

arranging of the cards, by the dealer and each player, into a low hand of one card, a medium hand of two cards and a high hand of four cards so that poker hands of four of a kind, and two pair, can potentially be formed by the four cards of the high hand, wherein the medium hand must be higher in rank than the low hand and the high hand must be higher in rank than the medium hand, individually comparing each of the low, medium and high hands of each player with the low, medium and high hands of the dealer;

determining a winner between each player and the dealer when at least two out of the three hands of one is of higher rank than the corresponding hands of the other, wherein when the dealer and a player have a corresponding hand of equal rank, and the dealer is determined to be the winner.

11. The method of claim 10, wherein the rankings of the high hands of four cards, from highest to lowest poker hand, is as follows:

(i) four aces;

(i) a royal flush formed by A, K, Q, J of the same suit;

(iii) a straight flush formed by four cards in consecutive rank of the same suit, wherein the highest ranking straight flush is A, 2, 3, 4 of the same suit and the second highest is K, Q, J, 10 of the same suit;

(iv) a flush formed by four cards of the same suit, regardless of rank, wherein the highest ranking card determines the highest flush;

(v) a straight formed by four cards consecutive in rank, regardless of suit, wherein the highest ranking card will determine the highest straight, wherein A, K, Q, J is the highest ranking straight, A, 2, 3, 4 is the second highest straight and 5, 4, 3, 2 is the lowest straight;

(vi) three of a kind formed by three cards of the same rank regardless of suit wherein three aces is the highest ranking three of a kind and three twos is the lowest ranking three of a kind;

(vii) two pair formed by two different pairs of the same rank in the same hand, wherein two aces and two kings is the highest ranking two pair, and two threes and two twos is the lowest ranking two pair;

(viii) one pair wherein two aces is the highest ranking pair and two twos is the lowest ranking pair; and (viiii) no pair, which occurs when none of the poker hands set forth above are formed and wherein the highest ranking single card will determine the winner, and wherein, in comparing hands of a player of that of the dealer, the highest ranking card is identical, the next highest ranking card will determine the winner.

12. The method of claim 11, wherein for medium hands, the highest hand is a pair of aces and the lowest hand is 2, 3.

13. The method of claim 12, wherein for low hands, the highest hand is an ace and the lowest hand is a two.

14. The method claim 11, wherein the dealer is a casino customer.

15. The method of claim 10, wherein the dealer is a casino employee.

16. The method claim 1, wherein the four cards of the high hand can also be selectively formed into poker hands of four card straight flushes, four card straights and four card flushes, depending on the cards that are dealt.

17. The method claim 11, wherein the four cards of the high hand can also be selectively formed into poker hands of four card straight flushes, four card straights and four card flushes, depending on the cards that are dealt.

* * * * *